US011528985B2

(12) United States Patent
Preston

(10) Patent No.: US 11,528,985 B2
(45) Date of Patent: Dec. 20, 2022

(54) PLUMBING SAFETY DEVICE AND METHOD

(71) Applicant: Anthony Andre Preston, Los Angeles, CA (US)

(72) Inventor: Anthony Andre Preston, Los Angeles, CA (US)

( * ) Notice: Subject to any disclaimer, the term of this patent is extended or adjusted under 35 U.S.C. 154(b) by 0 days.

(21) Appl. No.: 17/238,564

(22) Filed: Apr. 23, 2021

(65) Prior Publication Data

US 2022/0338612 A1 Oct. 27, 2022

(51) Int. Cl.
*A45F 5/00* (2006.01)

(52) U.S. Cl.
CPC ..... *A45F 5/00* (2013.01); *A45F 2005/006* (2013.01); *A45F 2200/0575* (2013.01)

(58) Field of Classification Search
CPC ..... A45F 2005/006; A45F 2200/0575; A45F 3/14; A45F 2003/142; A45F 2003/002; A45F 3/02; A01D 34/902; A01D 34/90
USPC ..... 224/257–258, 268
See application file for complete search history.

(56) References Cited

U.S. PATENT DOCUMENTS 609,731 A * 8/1898 Carley ..... A45F 3/14 224/617
2,441,115 A * 5/1948 Lambert ..... A45F 5/00 224/259
3,152,738 A * 10/1964 Worsfold, Jr. ..... A45F 5/00 224/259
3,559,853 A * 2/1971 Strassman ..... A45F 5/00 294/149
6,158,636 A * 12/2000 Latiolais ..... A45F 3/14 224/257
6,892,914 B2 5/2005 Girbert
7,093,366 B2 * 8/2006 Black ..... A01G 3/053 16/427
7,765,650 B2 * 8/2010 Bowater ..... F16L 33/08 24/274 R
7,817,002 B2 10/2010 Fullerton et al.
8,534,515 B2 * 9/2013 Muchin ..... A01D 34/902 224/264
10,517,376 B2 * 12/2019 Neal ..... A01D 34/902
2002/0179023 A1 * 12/2002 Axel ..... A01K 27/003 119/801
2007/0033752 A1 * 2/2007 Hung ..... B08B 9/045 15/104.2

(Continued)

*Primary Examiner* — Adam J Waggenspack
(74) *Attorney, Agent, or Firm* — Omni Legal Group; Omid E. Khalifeh; Lara A. Petersen

(57) ABSTRACT

A plumbing safety device and method is provided. The plumbing safety device comprises a shoulder strap configured to be worn over one or more shoulders of an operator, a mounting strap removably connected to the shoulder strap, and a means for securing a plumbing tool. The plumbing safety method comprises the steps of: providing a plumbing safety device comprising a shoulder strap configured to be worn over one or more shoulders of an operator and having a first and second strap connecting means, a strap adjustment means, a mounting strap removably connected to the shoulder strap, and a means for securing a plumbing tool; adjusting the strap adjustment means to a desirable strap length; securing the means for securing the plumbing tool to the plumbing tool; and placing the shoulder strap on the one or more shoulders of the operator.

13 Claims, 5 Drawing Sheets

(56) References Cited

U.S. PATENT DOCUMENTS

| | | | | |
|---|---|---|---|---|
| 2007/0261213 | A1* | 11/2007 | Nolan | A45F 3/14 24/300 |
| 2011/0035907 | A1* | 2/2011 | Cousineau | F01N 13/1805 24/19 |
| 2011/0180577 | A1* | 7/2011 | Woodward | A45F 5/00 224/411 |
| 2013/0160302 | A1* | 6/2013 | Pellenc | A45F 3/14 30/275.4 |
| 2014/0369019 | A1* | 12/2014 | Sabia | B24B 23/005 361/828 |

* cited by examiner

PLUMBING SAFETY DEVICE AND METHOD

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to safety devices and methods and, more particularly, to a plumbing safety device configured to be worn by an operator so as to free the operator's hands and minimize the risk of injury and damage to self and property while performing manual labor, such as plumbing tasks.

BACKGROUND

Many manual labor-intensive tasks involve specific tools or machinery. Much of the time, manual laborers must support the weight of such tools or machinery while performing a given task. Because these tools are often heavy or bulky, tasks involving such tools are difficult at best. For instance, plumbing tools, such as drain guns, are particularly heavy and carry therewith a significant risk to person and property. In particular, the operator's body can become fatigued and lose hold of the plumbing tool causing it to contact countertops, sinks, or other nearby installations, thereby damaging the same. Moreover, the operator's body itself may become injured as a result of performing tasks while maintaining the weight of heavy tools or machinery.

Some attempts have been made to address the issue of supporting heavy or bulky tools or machinery while performing manual labor tasks. For instance, U.S. Pat. No. 7,817,002 to Fullerton et al. discloses a correlated magnetic belt and method for using the same. This tool belt provides correlated magnets which can have objects secured to and removed from. However, this device is insufficient to hold and carry large or massive tools.

Another attempt is seen with regard to U.S. Pat. No. 6,892,914 to Girbert, which teaches a carrier for battery powered tools. In this disclosure, the carrier is worn over the user's shoulder and comprises a pocket for properly positioning a battery powered tool. While this teaching has the advantage of providing a means of carrying the tool from one place to another, it fails to teach a carrier for supporting the weight of the tool while the tool is in use.

Overall, none of the aforementioned attempts comprise the advantages of the present invention. As such, there remains a need for a plumbing safety device and method for supporting the weight of a heavy or bulky tool or machinery so as to free the hand of an operator thereof. There also remains a need for a plumbing safety device and method which minimizes or eliminates the risk of injury to self or damage to property while performing plumbing, or other manual labor, tasks involving heavy or bulky tools or machinery.

SUMMARY

The present disclosure is directed to plumbing safety devices that may eliminate the risk of injury to self and damage to property while performing plumbing tasks. More particularly, the plumbing safety device may support the weight of heavy tools and machinery so as to free a hand of an operator for use. In this manner, the plumbing safety device may minimize the risk of long-term damage to the operator's body, such as the back. The plumbing safety device may further eliminate the risk of damage to a surrounding work area, such as the risk of dropping the tool or machinery or any rotating portions thereof along a surface.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In accordance with one embodiment, the plumbing safety device may comprise a shoulder strap, a mounting strap and a means for securing a plumbing tool. The shoulder strap may be configured to be worn over one or more shoulders of an operator. The operator may be a plumber, construction worker, or other individual engaged in manual labor. The mounting strap may be removably connected to the shoulder strap. In alternate embodiments, the plumbing safety device may comprise the shoulder strap and the means for securing the plumbing tool.

The shoulder strap may comprise a first strap connecting means, a second strap connecting means, and a strap adjustment means. The shoulder strap may be further defined by a first end and a second end. In some embodiments, the shoulder strap may further comprise a shoulder pad. The shoulder pad may be sized to accommodate the one or more shoulders of the operator and may be formed of leather, plastic, fabric, rubber, foam, or other soft, desirable material.

The first strap connecting means and the second strap connecting means may connect the shoulder strap to the mounting strap. As such, the first strap connecting means may be disposed along the first end of the shoulder strap and the second strap connecting means may be disposed along the second end of the shoulder strap. In certain embodiments, one or more of the first strap connecting means and the second strap connecting means may be formed of metal, plastic, steel, or other desirable material. As an example, the first strap connecting means and/or the second strap connecting means may comprise one or more carabiners.

The shoulder strap may also comprise the strap adjustment means. While the shoulder strap may be of sufficient length to accommodate the one or more shoulders and torso of the operator, the strap adjustment means may allow the operator to adjust the shoulder strap to a desirable strap length. The desirable strap length may also be based on the size and weight of the plumbing, or other, tool. The strap adjustment means may be formed of plastic, metal, brass, steel, or other desirable material.

The mounting strap may connect the shoulder strap to the means for securing the plumbing tool and may further comprise the one or more lashing points. The one or more lashing points may be disposed along one or more of a first end of the mounting strap and a second end of the mounting strap. According to certain embodiments, the one or more lashing points may be formed of plastic, metal, brass, steel, or other heavy-duty material. For instance, the one or more lashing points may comprise one or more D rings.

In some embodiments, the shoulder strap and/or the mounting strap may be formed out of a heavy-duty material, such as polypropylene. The shoulder strap and/or the mounting strap may comprise other materials as well, such as polyester. A person of ordinary skill will understand that the shoulder strap and/or the mounting strap may be formed out of other desirable or convenient fabrics or materials capable of sustaining the weight of the plumbing tool while comfortably resting on the one or more shoulders of the operator.

The means for securing the plumbing tool may connect the shoulder strap and the mounting strap to the plumbing tool and further secure the plumbing tool. The plumbing tool may comprise any plumbing tool, and in particular, may comprise a heavy and/or bulky plumbing tool. By way of example, the plumbing tool may comprise a drain gun. In further embodiments, the plumbing tool may be another type of tool as well, including those not for use in plumbing. While a person of ordinary skill will recognize numerous types of means for securing the plumbing tool may be suitable for use in accordance with this disclosure, in some embodiments, the means for securing the plumbing tool may comprise a hose clamp. Moreover, the means for securing the plumbing tool may comprise other types of clamps, or even, a hook, latch, or any other suitable securing means recognized by those skilled in the art.

In one embodiment of the present invention, a method involving the aforementioned plumbing safety device may be used to minimize the risk of injury to self and property and also improve operator comfort while performing a plumbing task or other task requiring use of a heavy or bulky tool. The method may comprise the steps of: providing a plumbing safety device comprising a shoulder strap configured to be worn over one or more shoulders of an operator and having a first and second strap connecting means, a strap adjustment means, a mounting strap removably connected to the shoulder strap, and a means for securing a plumbing tool; adjusting the strap adjustment means to a desirable strap length; securing the means for securing the plumbing tool to the plumbing tool; and placing the shoulder strap on the one or more shoulders of the operator.

Securing the mans for securing the plumbing tool to the plumbing tool may further comprise providing a hose clamp as the means for securing the plumbing tool; and securing the hose clamp around one or more portions of the plumbing tool.

One or more of the above-disclosed embodiments, in addition to certain alternatives, are provided in further detail below with reference to the attached figures. The disclosed subject matter is not, however, limited to any particular embodiment disclosed.

Figure 1:
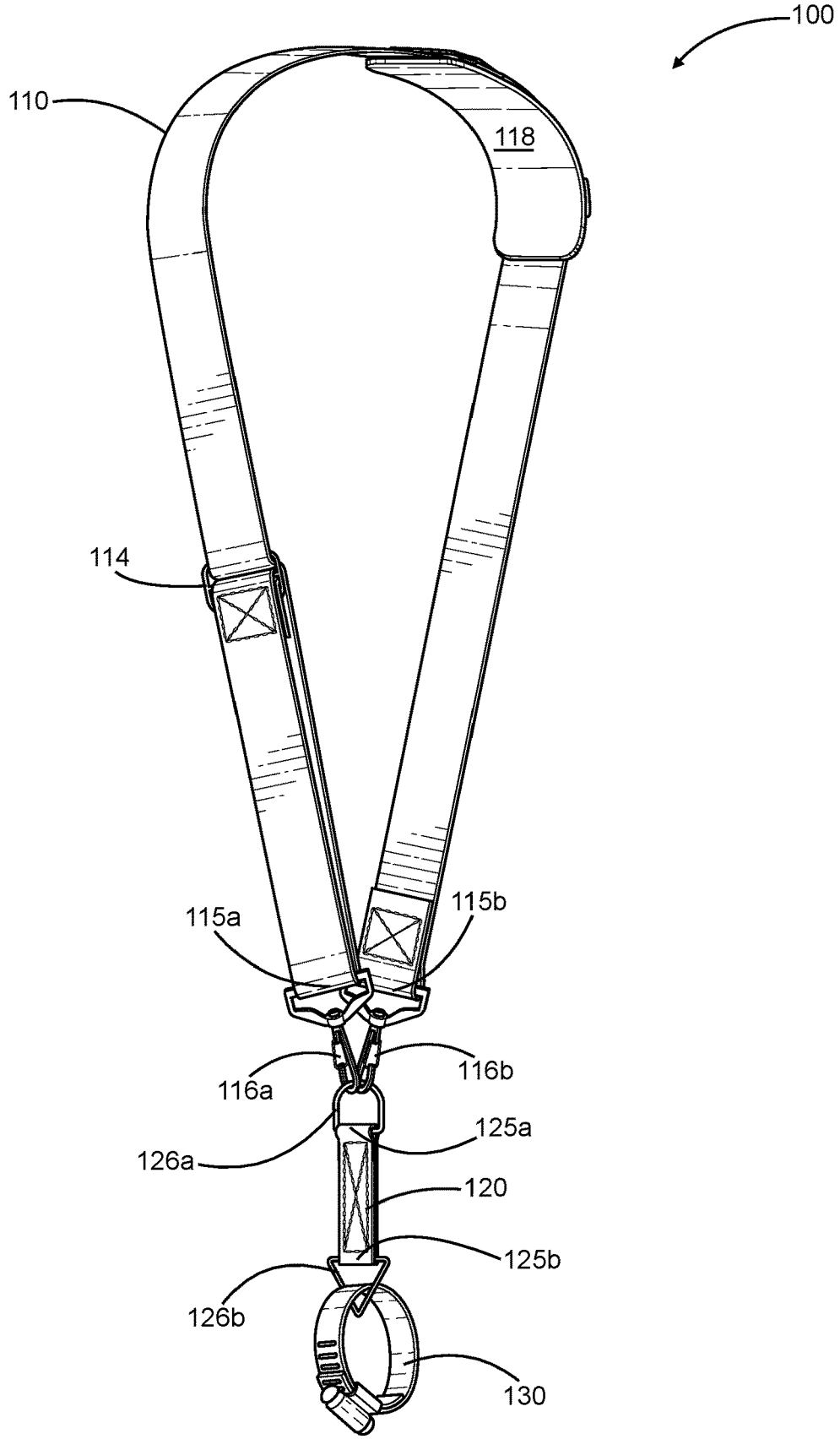
FIG. 1 shows a perspective view of an embodiment of the plumbing safety device.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIGS. 1-4, a plumbing safety device is provided that, in some embodiments, may eliminate or minimize the risk of injury or damage to self or property while performing manual labor involving heavy tools. The plumbing safety device may also support the weight of heavy or bulky tools or machinery which, in some instances, may free up an operator's hand to use the tool or machinery or perform other tasks.

In certain exemplary embodiments discussed throughout this disclosure, the plumbing safety device may relate to plumbing tools. However, it is to be understood that the device discussed herein may be utilized in connection with other heavy and/or bulky tools or machinery. In this way, the safety device is not limited to plumbing tools or machinery.

As shown in FIG. 1, the plumbing safety device 100 may comprise a shoulder strap 110, a mounting strap 120, and a means for security a plumbing tool 130. The shoulder strap 110 may be configured to be worn over one or more shoulders 310 of an operator 300. The mounting strap 120 may be removably connected to the shoulder strap 110. The means for securing the plumbing tool 130 may be removably connected to the mounting strap 120.

Figure 2:
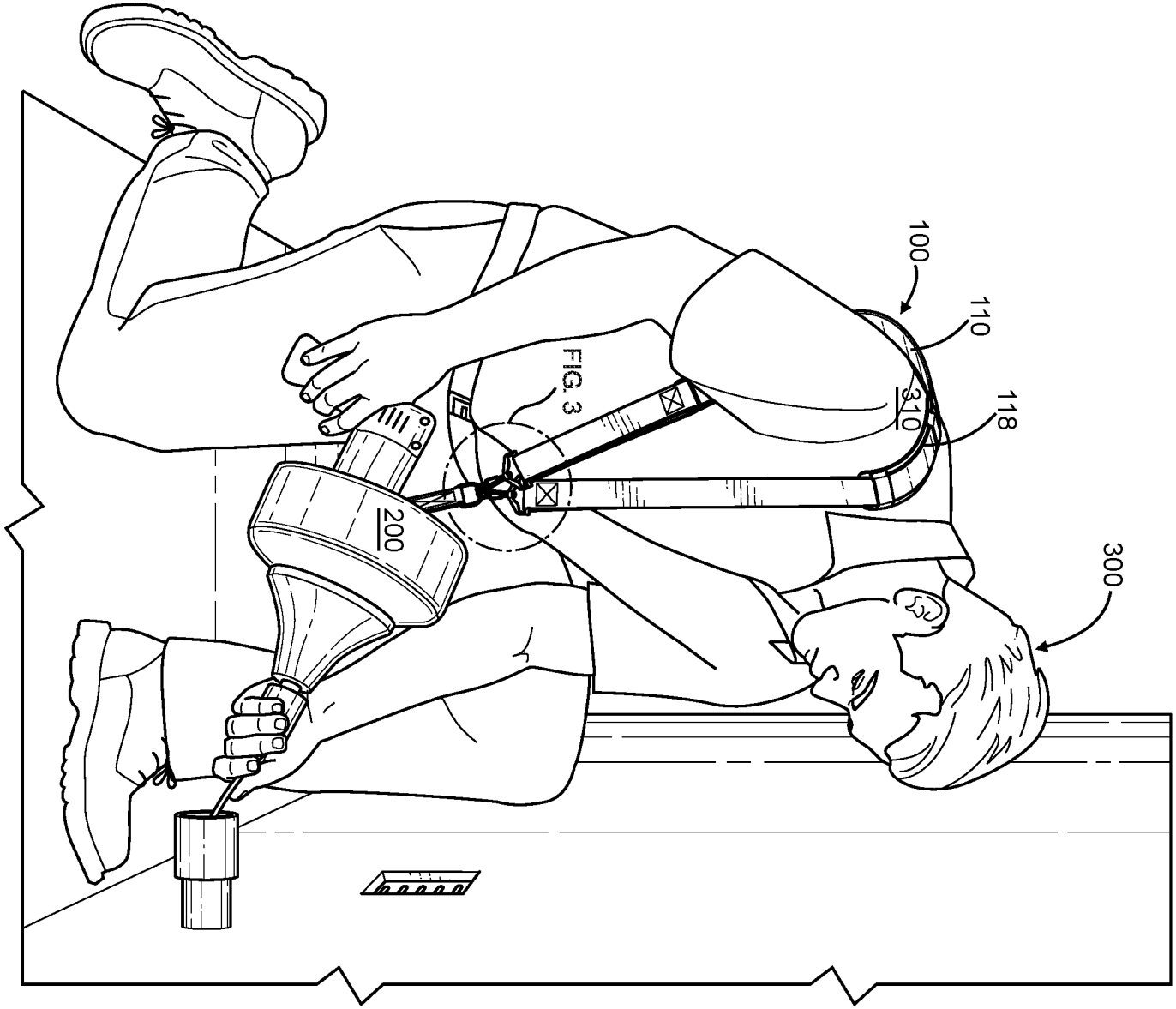
FIG. 2 shows a perspective view of an embodiment of the plumbing safety device.

In some exemplary embodiments, including as shown in FIG. 2, the operator 300 may be a plumber. Indeed, as discussed throughout this disclosure, the operator 300 may be described as the plumber. In other embodiments, the operator 300 may be another manual laborer. In still other embodiments, as a person of ordinary skill in the art would understand, the operator 300 may be virtually any type of human or animal. Similarly, throughout this disclosure, the plumbing tool 200 may be described as a tool for use during plumbing tasks. That being said, in other embodiments, the plumbing tool 200 may comprise virtually any type of tool that is heavy and/or bulky. As one example, as shown in the FIGS., the plumbing tool 200 may comprise a drain gun.

With attention back to FIG. 1, the shoulder strap 110 may be defined by a first end 115*a* and a second end 115*b*. The length of the shoulder strap 110, that is, the distance between the first end 115*a* and the second end 115*b* when the shoulder strap 110 is at full length, may be any length suitable to be worn over one or more shoulders 310 of the operator 300. In certain embodiments, the shoulder strap 110 may be between twelve (12) inches and sixty-five (65) inches in length. For example, the shoulder strap 110 may be fifty-four (54) inches in length. Moreover, the shoulder strap 110 may be between 0.5 inches to 3 inches in width. For instance, the shoulder strap 110 may be 1.5 inches in width.

According to some embodiments, the shoulder strap 110 may be formed of a heavy-duty material. As one example, the shoulder strap 110 may be formed of polypropylene. Alternatively, the shoulder strap 110 may be formed of polyester or a combination of polypropylene and polyester. In still other embodiments, the shoulder strap 110 may be formed of cotton, nylon, or any other desirable or available material or combination of materials.

Figure 3:
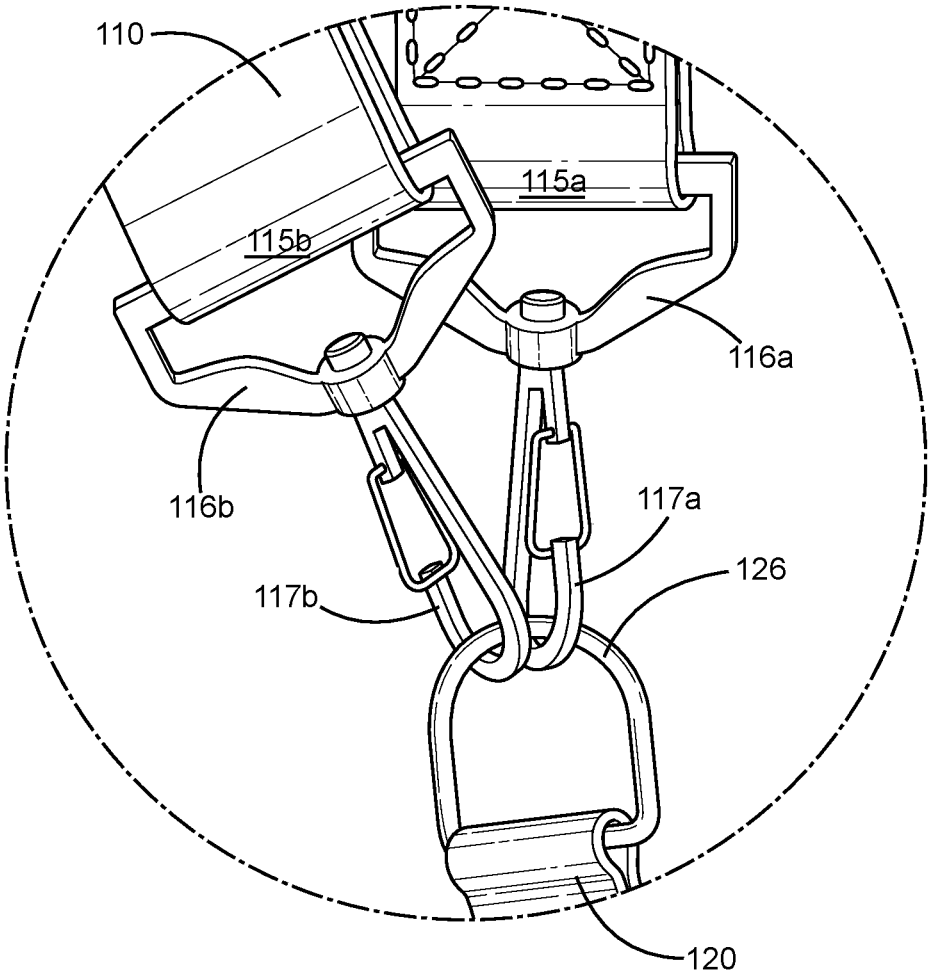
FIG. 3 shows a close-up view of an embodiment of the plumbing safety device.

As shown in greater detail in FIG. 3, the shoulder strap 110 may further comprise a first strap connecting means 116*a*, a second strap connecting means 116*b*, and a strap adjustment means 114. The first strap connecting means 116*a* may be permanently or removably disposed at the first end 115*a* of the shoulder strap. Similarly, the second connecting means 116*a* may be permanently or removably disposed at the second end 115*b*. Either or both of the first strap connecting means 116*a* and the second strap connecting means 116*b* may connect the shoulder strap 110 to the mounting strap 120.

The first strap connecting means 116*a* and the second strap connecting means 116*b* may comprise one or more carabiners. For instance, the first and second strap connecting means 116*a*, 116*b* may comprise 6 mm carabiners 117*a*, 117*b*. However, it is to be understood that the first strap connecting means 116*a* and the second strap connecting means 116*b* may comprise other connecting means, such as one or more swivel snap hooks or delta quick links. The first and second strap connecting means 116*a*, 116*b* may be formed of metal, plastic, steel, or any other desirable or available material or combination of materials.

In certain embodiments, the shoulder strap 110 may also comprise the strap adjustment means 114. The strap adjustment means 114 may allow the operator 300 to adjust the length of the shoulder strap 110 to a desirable strap length. In some embodiments, the desirable strap length may depend on the height of the operator 300 and/or the operator's torso. In other embodiments, the desirable strap length may depend on the size and weight of the plumbing tool 200.

As shown in FIGS. 1-2, in some embodiments, the strap adjustment means 114 may comprise a strap slider. In alternate embodiments, the strap adjustment means 114 may comprise a strap buckle or other means for adjusting the length of the shoulder strap 110. The strap adjustment means 114 may be formed of plastic, metal, brass, steel, or any other desirable or available material or combination of materials.

In further embodiments, the shoulder strap 110 may also comprise a shoulder pad 118. The shoulder pad 118 may alleviate the weight of the plumbing tool 200 and any resulting pain as felt by the operator 300 via the shoulder strap 110. Additionally, the shoulder strap 118 may render the plumbing safety device 100 more comfortable for use by the operator 300. In this manner, the shoulder pad 118 may be sized to accommodate the one or more shoulders 310 of the operator 300. The shoulder pad 118 may be formed of leather, plastic, rubber, or foam. In embodiments where the shoulder pad 118 may be formed of foam, the foam may be open cell, closed cell, and dual density.

With reference now to FIG. 1, the mounting strap 120 may connect the shoulder strap 110 to the means for securing the plumbing tool 130. The mounting strap 120 may be defined by a first end 125*a* and a second end 125*b*. The length of the mounting strap 120, that is, the distance between the first end 125*a* and the second end 125*b* may be any desirable length. In some embodiments, the mounting strap 120 may be between five (5) to sixteen (16) inches in length. For instance, the mounting strap 120 may be 9.25 inches in length. Moreover, the mounting strap 120 may be between 0.5 inches to 3 inches in width. For instance, the mounting strap 120 may be one (1) inch in width.

In accordance with certain embodiments, the mounting strap 120 may be formed of a heavy-duty material. For example, the mounting strap 120 may be formed of polypropylene. In other embodiments, the mounting strap 120 may be formed of polyester or a combination of polypropylene and polyester. In alternate embodiments, the mounting strap 120 may be formed of cotton, nylon, or any other desirable or available material or combination of materials.

With reference still to FIG. 1, the mounting strap 120 may further comprise one or more lashing points 126. As shown in FIG. 1, the one or more lashing points may comprise a first lashing point 126*a* and a second lashing point 126*b*. In this embodiment, the first lashing point 126*a* may be permanently or removably disposed at the first end 125*a* of the mounting strap 120 and the second lashing point 126*b* may be permanently or removably disposed at the second end 126*b* of the mounting strap 120. Either or all of the one or more lashing points 126 may connect to the shoulder strap 110 or the means for securing the plumbing tool 130.

The one or more lashing points 126 may be formed of plastic, metal, brass, steel, or other desirable or available material or combination of materials. In some embodiments, including those shown in the FIGS., the one or more lashing points 126 may comprise one or more D rings. In some embodiments, the one or more lashing points 126 may comprise one or more classic, D-shaped D rings or one or more triangle D rings. A person of ordinary skill in the art will recognize that the one or more lashing points 126 may comprise other lashing points or connecting means.

Figure 4:
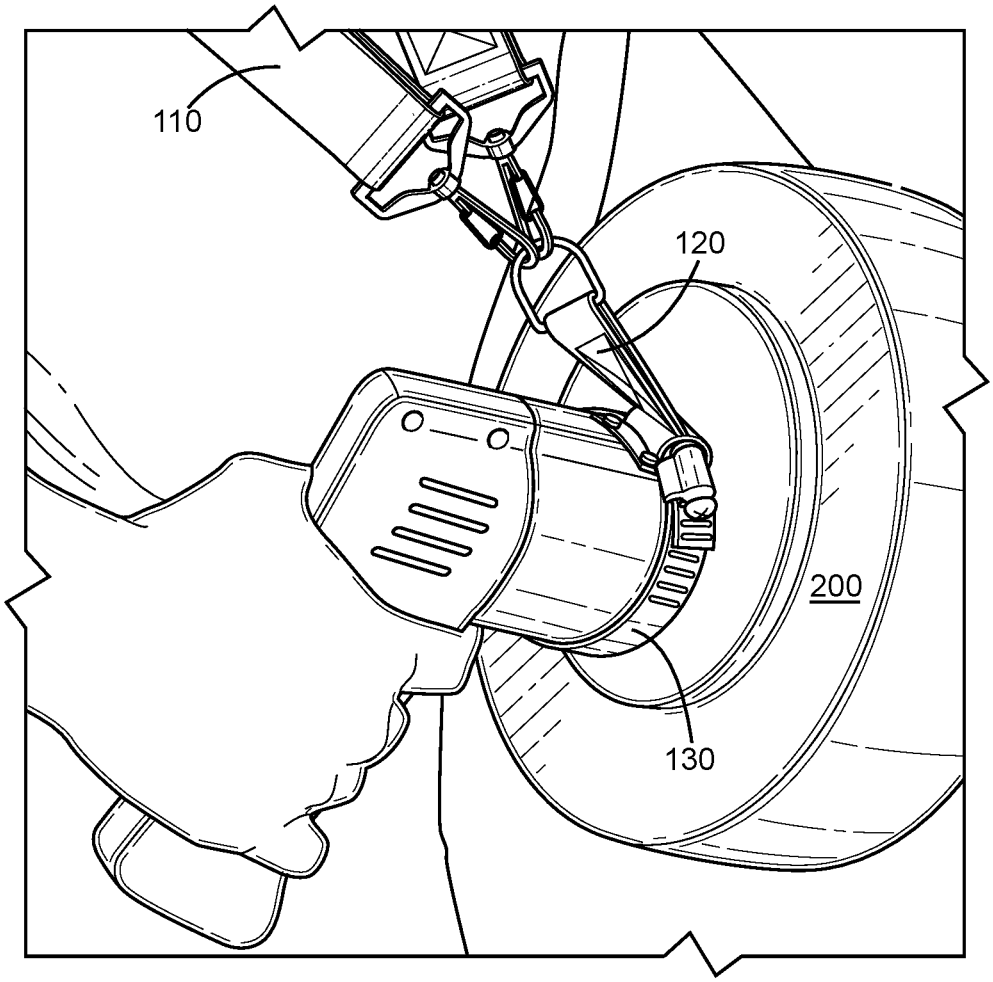
FIG. 4 shows a close-up view of an embodiment of the plumbing safety device.

As shown in FIGS. 1 and 4, the means for securing the plumbing tool 130 may connect the shoulder strap 110 and the mounting strap 120 to the plumbing tool 200. The means for securing the plumbing tool 130 may further secure the plumbing tool 200. As shown in greater detail in FIG. 4, the means for securing the plumbing tool 130 may comprise a hose clamp. In certain embodiments, the hose clamp may comprise a worm drive (screw) hose clamp. The hose clamp may further comprise a spring clamp, a wire clamp, an ear clamp, or a racing clamp. Alternatively, the means for securing the plumbing tool 130 may also comprise a hook, latch, or virtually any other means for securing a tool or machinery or a portion thereof.

Figure 5:
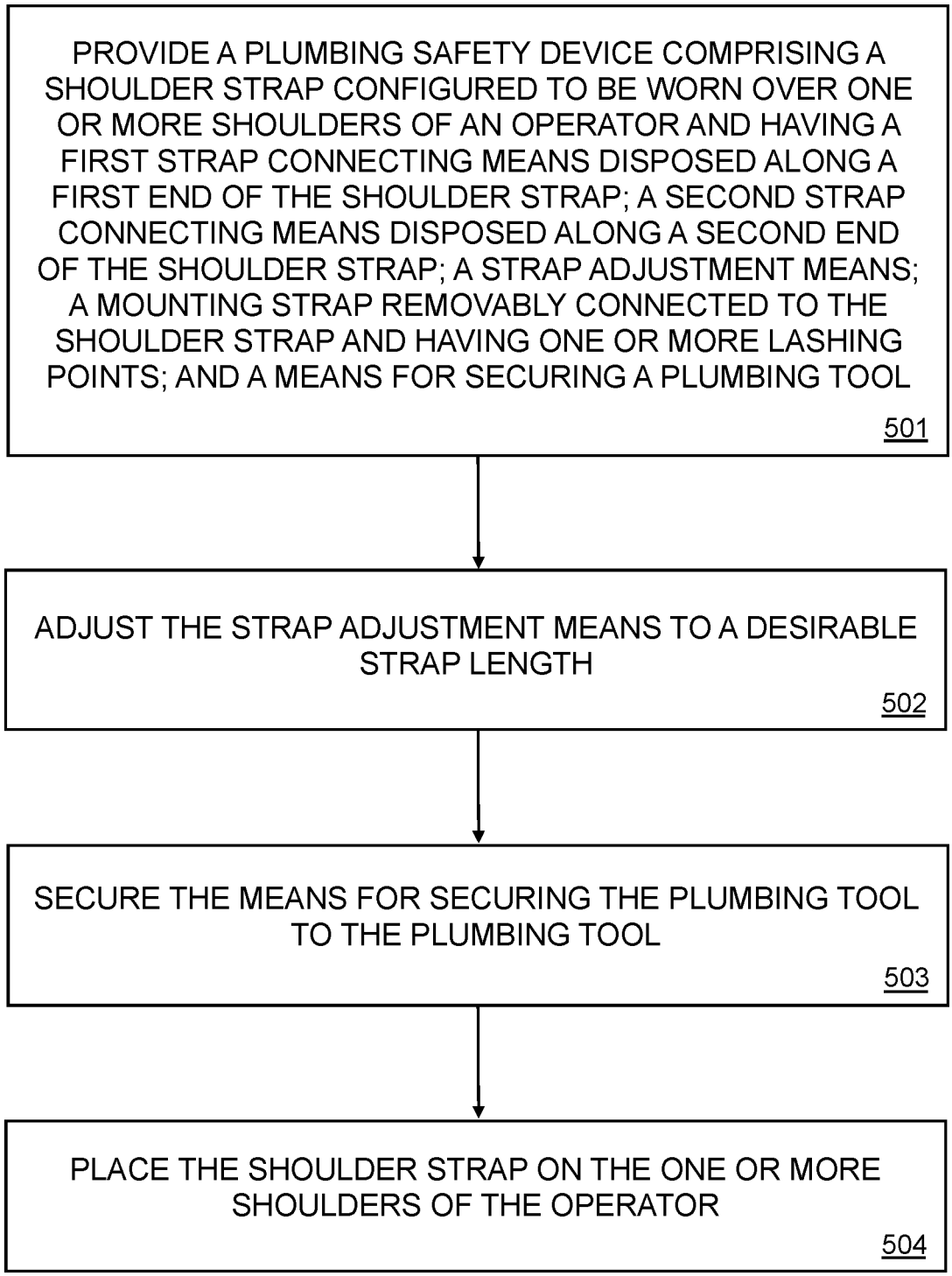
FIG. 5 shows an embodiment of the plumbing safety method.

With reference to FIG. 5, one embodiment of the present invention may involve a method of using the aforementioned plumbing safety device. FIG. 5 illustrates a flowchart of one method of this invention. The method may minimize or eliminate the risk of injury to self and damage to property. In addition, the method may enhance the comfort of the operator while performing manual labor tasks.

In certain embodiments, including that demonstrated in FIG. 5, the plumbing safety method may comprise the steps of: providing a plumbing safety device comprising a shoulder strap configured to be worn over one or more shoulders of an operator and having a first and second strap connecting means, a strap adjustment means, a mounting strap removably connected to the shoulder strap, and a means for securing a plumbing tool (block 501); adjusting the strap adjustment means to a desirable strap length (block 502); securing the means for securing the plumbing tool to the plumbing tool (block 503); and placing the shoulder strap on the one or more shoulders of the operator (block 504).

Securing the means for securing the plumbing tool to the plumbing tool (block 503) may further comprise providing a hose clamp as the means for securing the plumbing tool; and securing the hose clamp around one or more portions of the plumbing tool. In some embodiments, the hose clamp may comprise a worm drive, or screw, hose clamp.

Placing the shoulder strap on the one or more shoulders of the operator (block 504) may further comprise providing the plumbing safety device further comprising a shoulder pad; and positioning the shoulder pad on the one or more shoulders of the operator. The operator may position the shoulder pad on its one or more shoulders as desired for comfort or for utility. In alternate embodiments, the operator may position the shoulder pad away from its one or more shoulders.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the tool or machinery with which the plumbing safety device may be utilized may be a plumbing tool or any other heavy or bulky tool or machinery. Accordingly, it is intended that the invention not be limited, except as by the appended claims.

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the plumbing safety device and method with which that terminology is associated. In general, the terms used in the following claims should not be constructed to limit the plumbing safety device and method to the specific embodiments disclosed in the specification unless the above description section explicitly define such terms. Accordingly, the actual scope encompasses not only the disclosed embodiments, but also all equivalent ways of practicing or implementing the disclosed method and apparatus. The above description of embodiments of the plumbing safety device and method is not intended to be exhaustive or limited to the precise form disclosed above or to a particular field of usage.

While specific embodiments of, and examples for, the method and apparatus are described above for illustrative purposes, various equivalent modifications are possible for which those skilled in the relevant art will recognize.

While certain aspects of the method and system disclosed are presented below in particular claim forms, various aspects of the method and apparatus are contemplated in any number of claim forms. Thus, the inventor reserves the right to add additional claims after filing the application to pursue such additional claim forms for other aspects of the plumbing safety device and method.

What is claimed is:

1. A plumbing safety device, comprising a shoulder strap configured to be worn over one or more shoulders of an operator and having a first strap connecting means disposed along a first end of the shoulder strap;

a second strap connecting means disposed along a second end of the shoulder strap;

a strap slider configured to allow the operator to selectively adjust the shoulder strap to a fixed strap length;

a mounting strap removably connected to the shoulder strap and having one or more D rings disposed along each of a first end and a second end of the mounting strap; and a means for securing a plumbing tool removably connected to the mounting strap.

2. The plumbing safety device of claim 1, wherein one or more of the shoulder strap and the mounting strap are formed of polypropylene.

3. The plumbing safety device of claim 1, wherein one or more of the first strap connecting means and the second strap connecting means comprise one or more carabiners.

4. The plumbing safety device of claim 1, wherein the means for securing a plumbing tool is a hose clamp.

5. The plumbing safety device of claim 4, wherein the hose clamp is a worm drive hose clamp.

6. A plumbing safety device, comprising a shoulder strap of 54 inches in length and 1.5 inches in width configured to be worn over one or more shoulders of an operator and having one or more 6 mm carabiners disposed along a first end and a second end of the shoulder strap;

a strap slider configured to allow the operator to selectively adjust the shoulder strap to a fixed strap length;

a mounting strap of about 9.25 inches in length and one inch in width removably connected to the shoulder strap and having one or more D rings disposed along each of a first end and a second end of the mounting strap; and a hose clamp for removably securing a plumbing tool to the mounting strap.

7. The plumbing safety device of claim 6, wherein the hose clamp is a worm drive hose clamp.

8. The plumbing safety device of claim 6, further comprising a shoulder pad disposed along the shoulder strap.

9. The plumbing safety device of claim 8, wherein the shoulder pad is formed of leather foam, or rubber.

10. A plumbing safety method, comprising the steps of providing a plumbing safety device comprising a shoulder strap configured to be worn over one or more shoulders of an operator and having a first strap connecting means disposed along a first end of the shoulder strap;

a second strap connecting means disposed along a second end of the shoulder strap;

a strap slider configured to allow the operator to selectively adjust the shoulder strap to a fixed strap length;

a mounting strap removably connected to the shoulder strap and having one or more D rings disposed along each of the first end of the mounting strap and second end of the mounting strap; and a means for securing a plumbing tool removably connected to the mounting strap;

adjusting the strap adjustment means to a desired strap length;

securing the means for securing the plumbing tool to the plumbing tool; and placing the shoulder strap on the one or more shoulders of the operator.

11. The plumbing safety method of claim 10, wherein the first connecting means and the second connecting means comprise one or more carabiners.

12. The plumbing safety method of claim 10, wherein securing the means for securing the plumbing tool to the plumbing tool further comprises providing a hose clamp as the means for securing the plumbing tool; and securing the hose clamp around one or more portions of the plumbing tool.

13. The plumbing safety method of claim 12, wherein the plumbing tool is a drain gun.

* * * * *